United States Patent [19]

Livingston

[11] Patent Number: 4,836,222

[45] Date of Patent: Jun. 6, 1989

[54] PROCESS FOR TREATING TOBACCO

[76] Inventor: Larry J. Livingston, 4768 Hermitage Rd., Virginia Beach, Va. 23455

[21] Appl. No.: 215,522

[22] Filed: Jul. 6, 1988

[51] Int. Cl.[4] ..... A24B 15/30

[52] U.S. Cl. ..... 131/310; 131/300; 131/302

[58] Field of Search ..... 131/310, 309, 290, 302, 131/300

[56] References Cited

U.S. PATENT DOCUMENTS 2,224,833 12/1941 Pfeutzer et al. ..... 131/310

4,483,353 11/1984 Mitchell ..... 131/310

*Primary Examiner*—V. Millin

*Attorney, Agent, or Firm*—Lalos & Keegan

[57] ABSTRACT

A process for degreening and coloring tobacco by subjecting the tobacco to air containing ethylene gas and thereafter wilting, dehydrating and curing. The air containing ethylene gas is exchanged within a controlled environment at a substantially high rate to not only replenish the oxygen and nitrogen content, but also to remove the carbon dioxide generated in the coloring process that can inhibit further coloring. The process also permits increasing the temperature around the tobacco during the wilting and dehydrating stages so as to substantially decrease the total time required for curing the tobacco.

44 Claims, No Drawings

PROCESS FOR TREATING TOBACCO

BACKGROUND OF THE INVENTION

1. Field of the Invention

The present invention is directed to a process for degreening and coloring tobacco leaves and thereafter wilting, dehydrating and curing the tobacco in a shorter time. The process includes contacting the green tobacco with ethylene in a controlled atmosphere that is exchanged frequently to not only color the tobacco but also to replenish the oxygen and nitrogen content of the atmosphere and reduce the carbon dioxide produced during the process of curing.

The use of this process during the coloring stage of curing tobacco allows the temperature of the tobacco to be increased during both the wilting and dehydrating stages. Such a temperature rise during the wilting and dehydration stages decreases the time significantly to attain the final curing of the tobacco.

The curing of tobacco is an ancient art that has been practiced for centuries. With the advent of civilization the curing of tobacco became more scientific in order to achieve a more desirable color and taste sought by the discriminating user and those knowledgeable in the tobacco field.

Tobacco has been cured in environments in which the tobacco leaves are hung to dry. Under natural conditions, the time for such drying and curing to effect the desired color change would be typically many days and up to at least a week or more in some instances. Such a length of time was not acceptable leading to the determination that curing could be accelerated with the application of heat. Long ago a temperature rise in the curing environment would be brought about through the use of wood fires or kerosene burning from a wick. This procedure indeed did cut down the curing time at least several days and produced a cured out tobacco colored with a deep yellowish-orange color. This color represented tobacco that was mature and ready for use. When cured in this manner it was found that the tobacco also retained a high level of the natural oils present in tobacco.

There followed attempts to cure tobacco with other than the traditional fuels, such as wood or kerosene through the use of so-called modern curing fuels typical of which is propane. The use of propane however caused the tobacco to attain a lemon-greenish or brown color that was not the accepted mature deep yellowish-orange color forming the traditional standard. Also it was found that such tobacco cured with these fuels possessed a lower level of the natural oils than the traditionally cured tobacco. With careful research, it was learned that the loss of color and the natural oils was caused by the immediate exposure of the tobacco leaf to an artificial heat source by which the artificial heat produced a more rapid heating and drying. In contrast, the more traditional fuels that produced ethylene as a combustion product of the fuel caused a more natural and far slower curing. It become apparent that the lower curing produced a leaf that achieved a natural degradation of the chlorophyll prior to the destruction of chloroplast. It was also recognized that the ethylene in the combustion products of the traditional fuels brought about not only chlorophyll degradation but did so in such a way as to avoid destruction of the chloroplast so as to condition the tobacco leaf to respond to a subsequent faster rate of curing.

The ethylene in the tradiational fuels also assisted the enzymes necessary to increase respiration and ripening of the tobacco leaf so as to allow the leaf to hydrolize some of the materials and respire them away at a much lower temperature than would be possible if ethylene were not used. The presence of ethylene therefore enabled the leaf to respond much more quickly to the curing process than leaves not treated with ethylene as would have been the case with the curing fuels.

The result of the experience with ethylene is that it has become a well-known fact in the tobacco curing art that ethylene has a significant effect upon the curing process and does produce a leaf that is not only acceptable to the industry but more desirable than those leaves that have been artificially cured with curing fuels.

While it is always desirable to select the mature green leaves to attain quality tobacco even when ethylene is used, it has been found that, when tobacco leaves have grown under adverse weather conditions or with other environmental difficulties, such tobacco leaves will possess less than ideal quality, which ethylene can be used to improve. It has been found, for instance, that the ethylene ripening of those leaves that are not of superior quality can still produce a high quality cured tobacco leaf.

The prior art is replete with processes for providing cured tobacco. For instance, ethylene for curing tobacco has been generated by the catalytic conversion of ethyl alcohol. Such a process has been commercially successful in that it provided for the production of ethylene without the use of the large compressed gas tanks that would otherwise have supplied the necessary ethylene. However the process had the serious drawback that the ethylene was produced from ethyl alcohol that the law required to be denatured. The denaturing of the alcohol by the addition of various denaturants often produces undesirable reaction products other than ethylene. In addition, these denaturants gradually poison or otherwise degrade the active catalyst that is the basis for the reaction of ethyl alcohol into ethylene and thus produced not only less ethylene but more of the undesirable products.

The reaction products that are produced with a degraded catalytically generated ethylene can have adverse effects upon the quality of the cured tobacco and also at times make it difficult to determine what concentration is to be expected to be generated from the amount of denatured ethyl alcohol that is sought to be catalytically converted. Accordingly, it is believed that the ideal process for curing tobacco does not reside in the catalytic production of ethylene but rather in the use of ethylene even if it is in the compressed gas cylinders that have been in use in the past.

It is known through research performed by experts in the field that ethylene will induce degradation of chlorophyll and, at the same time, will accelerate the coloring process of tobacco even though this latter point is sometimes disputed because it is not clearly understood. It is also known that in addition to the chlorophyll degradation, ethylene acts as a degradation agent by increasing the transpiration of the moisture from the tobacco leaf. This of course results in the tobacco wilting and therefore allowing greater efficiency in drying due to the passage of the forced air used typically for drying.

The concentration of ethylene gas that has been used in the past varies considerably. It is known that the concentration of ethylene that is naturally released by the yellowing tobacco within a drying kiln has been observed to be 0.13–0.30 ppm. Over a 25 hour period of yellowing, the amount of ethylene released from leaf tissue is about 1.3 ppm per one thousand cubic centimeters of leaf area.

It has been reported in the literature that ethylene gas is useful to ripen fruits and vegetables when the concentration is in the range of 1 to 1,000 ppm and particularly when maintained at levels higher than that would have been present naturally. Armed with this knowledge, many in the art have believed that if a little ethylene gas would work well that a lot more would be better to produce a more significant ethylene response including faster ripening and improved color changes. Unfortunately this belief when put into practice has resulted in a number of explosions that caused serious injuries and deaths of personnel working within the curing barns. The reason for the explosion is that the level of ethylene reaches an explosive concentration when in the range of approximately 3.1%–32% by volume in air.

Safety has therefore been of primary importance in the use of ethylene. The typical catalytically produced gas was thought to be a solution to the problem of explosions. However, that expectation has not been proven to be satisfactory in practice. Gas contained in pressurized cylinders can be administered by a so-called shot method wherein the gas contained in the cylinder is quickly released or may be permitted to escape through a gas valve regulator that meters the release of ethylene over a period of time.

In any of these or other methods, the ethylene concentration is still so variable and uncontrolled that explosions do occur and the curing process is still slow not able to produce quickly the proper color of the tobacco leaf. Increasing the speed of the curing process to produce the proper color has been sought therefore is as yet an unattainable goal, particularly when an unsafe ethylene concentration must be avoided.

In another area of concern, it is known in the art that carbon dioxide, though desirable in minute quantities where it can have a beneficial effect upon the ethylene action, does at higher concentrations deleteriously affect the ethylene response. It has been determined that the presence of the carbon dioxide, directly or indirectly, competes with ethylene at sites within the plant tissue thereby retarding the degradation of the chlorophyll. The increase of carbon dioxide is naturally achieved during the ripening and curing process and unless removed or controlled will negate many of the benefits of the ethylene in the atmosphere.

In the past, it has been known to periodically open doors of curing barns or ripening rooms to prevent the buildup or increase in the concentration of carbon dioxide. This haphazar approach to the removal or lessening of the carbon dioxide level by exchanging the air at most several times a day never addressed any of the problems in a manner that produced satisfactory results.

Tobacco treated with ethylene is capable of coloring faster, but it is desired that the time for the wilting and dehydrating stages also be shorted so as to accelerate the total curing time required for the tobacco. No prior art process is known to exist that adequately accelerates the curing time.

OBJECTS OF THE INVENTION

The principal object of the present invention is to provide an improved process for curing tobacco by controlling the conditions for degreening and coloring as well as wilting and dehydrating.

A further object of the present invention is to accelerate the curing of tobacco leaves and yet produce a high quality cured tobacco leaf.

A further object of the present invention is to provide the process for the curing of tobacco with ethylene that is safe from the explosive concentrations previously experienced.

Another object of the present invention is to provide a process in which the concentration of ethylene is maintained at a specific low level and wherein the air is exchanged frequently.

A more specific object of the present invention is to control the conditions for coloring the tobacco leaf with ethylene in order to allow such significant increases in the temperature during wilting and drying that the total time for curing the tobacco is substantially reduced.

Another object of the present invention is the control of the carbon dioxide level while curing tobacco leave in order to attain the maximum benefit from the ethylene environment.

A further and more general object of the present invention is to provide a method for curing tobacco leaves that is more rapid and more economical while being safer than those prior art processes.

Other objects and advantages of the present invention will become more evident to those persons having ordinary skill in the art after a careful perusal of the following description of the preferred embodiments.

SUMMARY OF THE INVENTION

The present invention is a process for degreening and coloring tobacco leaves with ethylene and thereafter wilting and drying the tobacco to accelerate the curing process. Ethylene is used during the coloring stage in very low and specific concentrations of 25–75 parts per million while continuously exchanging the air within the curing environment approximately 10–110 times per 24-hour period so as to not only dehydrate the tobacco while affecting the degradation of the chlorophyll but also to replenish the oxygen and nitrogen content of the atmosphere while reducing the carbon dioxide produced during the curing process.

The use of ethylene in a controlled atmosphere during the coloring process enables the subsequent wilting and drying stages to be speeded up considerably by raising the temperature 2° F.–3° F. per hour until the maximum temperatures of 118° F. and 160° F. respectively have been achieved.

DESCRIPTION OF THE PREFERRED EMBODIMENT

The present invention includes subjecting the tobacco to a low concentration of ethylene held within a narrow range for a specified time period. The concentration of ethylene is maintained within the narrow range by continuously exchanging, at a substantially high rate, the air located about the tobacco. Continuous circulation of this air prevents the buildup of high concentrations of ethylene at or near the surface of the tobacco for any substantial period of time.

Degreening and coloring of the tobacco, according to the present invention, typically involves placing the tobacco leaves, within a substantially well sealed room or container that may be a contemporary curing barn. The tobacco is arranged within the room so as to have adequate exposure to the atmosphere within the room for full contact with the ethylene. Ethylene gas is then applied to the atmosphere within the room while the air within the room is exchanged at a substantially high rate. Circulation of the air ensures uniform exposure of the outer surface area of the tobacco to the air containing ethylene within the room.

While it is known to utilize a broad range of ethylene concentrations, such concentrations have fluctuated so widely and uncontrollably that it was never certain what concentration existed at any time when applied to the curing of tobacco. Accordingly, the process of the present invention is the recognition that a specific range of concentration of ethylene gas is not only more safe but also much more effective than any prior method using concentrations within the broad range of 1–1,000 ppm.

The concentration of ethylene found to be particularly useful is that within the broad range of 25–75 ppm of ethylene. Even more desirable results, however, are obtainable when the optimum concentration of ethylene is in the range of 45–65 ppm.

If the range of ethylene is much below the specified lower limit of 25 ppm, the effectiveness of ethylene is diminished, but when above the upper ranges, in accordance with the present invention, the outside of the leaf tends to show signs of color break, while the inside of the leaf shows little change in its physiological appearance. The effect of such higher concentrations of ethylene prevents the ideal color of a deep yellowish-orange from being attained. While these concentrations are of significant importance, it is not to say that some minor fluctuations outside of this range for a short period of time would totally destroy the benefits of the present invention.

During the degreening or coloring stage, the ethylene at these ranges of concentration is specified can be essentially kept "alive" for greater and quicker ethylene absorption that produces in the tobacco leaf the capability of, not only attaining the deep yellowish-orange color, but also being wilted and dried much more rapidly at the subsequent stages of curing.

The conditions that enable the coloring stage to be successful in bringing about the physiological changes in the tobacco include not only the presence of ethylene but the frequent exchange of air in the enclosure, barn or other contained space of the tobacco leaf. To maintain the leaf in a "live" condition, the environment preferably is maintained with a relative humidity that will not dry the leaf to any significant degree, but rather maintain the leaf at approximately its original moisture content. These conditions are to be detailed and explained in the subsequent description of the preferred embodiment.

The ethylene must, of course, be free to effect the physiological changes in the tobacco leaf. It has been found however, that the presence of carbon dioxide in concentrations above 3% by volume in the space for treating the tobacco would pose a serious obstacle in achieving the benefits from the ethylene treatment. Even concentrations as high as 1% carbon dioxide are undesirable.

The concentration of carbon dioxide should be in the range of 0.25–0.5 percent by volume of the detrimental effects of high carbon dioxide are to be avoided. When the concentration of carbon dioxide is controlled at this level, the ethylene treatment process is actually enhanced rather than retarded. This concentration of carbon dioxide, while important, is not critical to the basic invention.

The important aspect of the present invention is the control of the environment for the tobacco leaves. Accordingly, it has been found that the air within the contained space, in which the curing of the tobacco occurs, should be continuously exchanged approximately 10–110 times per 24-hour period. Improved results are obtained by exchanging the air 85–100 times per 24-hour period. The efficiency of the coloring of the tobacco leaves within the concentration ranges for ethylene, as previously stated, decreases significantly when the exchange rate is below the lower limit of 10 times per 24-hour period.

When the rate is changed more frequently than 110 times per 24-hour period, it has been found that tobacco damage can occur provided that the exchange is maintained over a substantial period of time above the upper limit of 110 exchanges per 24-hour period. This exchange rate is significantly higher than that recognized in the past where, for the most part, the exchanges of the environment were haphazard and accomplished simply by opening a barn door, or operating a fan without regard to the specific exchange rate. These exchanges could not have been greater than several per day, which would be inadequate for the purposes of the present invention.

It has been discovered, in accordance with the present invention, that the high rate of exchange of air in the environment around the tobacco leaves removes the carbon dioxide produced by the tobacco during the coloring stage of the curing process. If this carbon dioxide is not removed, the coloring process is inhibited. Also importantly the exchanging of the air replenishes the nitrogen concentration in contact with the tobacco. It is not certain what specific effect the nitrogen has except that it appears to stabilize the ethylene response and does not appear to be previously recognized as a significant factor in any process for the curing of tobacco.

The exchange of air also replenishes the concentration of oxygen that is essential for the oxidation reactions occurring within the tobacco leaf during the drying and curing process. The desirable concentrations of nitrogen and oxygen have not as yet been established except that no upper limit is recognized to be significant beyond the concentration of nitrogen and oxygen normally in air. Accordingly, concentrations of nitrogen of about 78% by volume and oxygen of 21% by volume are the desired goals. Concentrations lower than these amounts have been found to have some detrimental effects through the particular concentrations of both nitrogen and oxygen are not critical to the present invention.

According to the present invention, ethylene gas is added to the air being exchanged within a contained space. The ethylene gas can be added to the contained air by slowly metering almost pure ethylene gas from a cylinder provided with a gas regulator. The ethylene gas then is circulated by air movers, and diffused into the remainder of the atmosphere within the contained space. It is also within the scope of the present invention to have ethylene gas released into a stream of air entering the contained space for circulation purposes. The stream of air would be produced in a conventional manner as by a blower positioned adjacent the contained space.

The contained space is provided with at least one opening for allowing the circulation of air into and out of the contained space by a forced ventilation system using a fan or blower. The air leaving the contained space carries away from the contained space some of the moisture and substantially all of the carbon dioxide derived fromm the coloring stage of the tobacco and allows the replenishment of fresh air containing nitrogen and oxygen.

The relative humidity of the air being exposed to the plant tissue has a significant effect upon maintaining the efficiency of the coloring process. During this portion of the curing process, the air being circulated throughout the room picks up substantial amounts of moisture from the surface of the tobacco leaf. As the leaf is being exposed to the continuously exchanged air containing ethylene, moisture droplets are formed on the surface of the leaf. In fact, so much moisture collects on the surface of the plant tissue that it drips off the leaf onto the floor of the room. The circulating air continuously evaporates at least a portion of the moisture on the surface of the tobacco leaf and floor of the room. The moisture laden air exits from the room removing only a portion of the total moisture available from the leaf so as to maintain the leaft "alive" to be capable of undergoing the full effects of ethylene concentration.

The moisture air content of the air exiting the room is held at approximately 85–95% relative humidity in order to achieve the goals, and preferably 85–90% relative humidity.

The coloring stage of the curing process consumes about approximately 18–30 hours but could be 12–48 hours. The time is not critical, but, of course, it is desirable to use as little time as necessary to achieve the yellowish-orange color. The temperature is not critical in the coloring stage and is usually ambient, i.e. about 70° F.–100° F.

At the completion of the coloring stage, the effect of the ethylene treatment in the coloring stage can be utilized by raising the temperature, within the contained space, 2° F.–3° F. per hour in both the subsequent wilting stage and the drying stage. This increase in temperature accelerates the completion of both of these stages.

In the wilting stage, the heat can be increased 2° F.–3° F./hour, or preferably 2° F.–2½° F./hour, up to a maximum of about approximately 118° F. Much beyond about 120° F. as an approximate maximum temperature, the beneficial effects of the process are lost. There is not further need for any added ethylene concentration because the effect of the ethylene has been attained in the coloring stage.

The exchange of air is not critical although highly desirable to be maintained at about approximately the level of 30–60 exchanges per 24 hours and most preferably 40–50 exchanges per 24 hours. The time for the wilting stage is 4–15 hours while 6–12 hours is preferable.

As should be apparent, the coloring stage attempts to maintain the leaf in "live" condition with approximately the same moisture content as in the original leaf. In the wilting stage the lower relative humidity of the air in the exchanges partially dries the leaf to achieve the wilting stage.

After the wilting stage the tobacco leaf undergoes the drying stage for the completion of the curing process.

For drying, the temperature can be increased 2° F.–3° F./hour until an approximate maximum of 160° F. is achieved. The leaf deteriorates at temperatures above approximately 160° F. Preferably, 2° F.–2½° F. is the rate of temperature increase that can be used. A drying time of at least 50 hours is required. A time of 50–60 is preferable to dry the leaf to desirable moisture content although as much as 72 hours or more may be required to achieve the dried and fully cured leaf.

The temperature of the drying is best above about 140° F. up to the approximate 160° F. maximum. At this temperature the relative humidity can drop to approximately about 20%–30% R.H., although this not critical. The air exchange may be very low and can be for instance about approximately 6–10 exchanges per 24 hours.

It should be apparent that in accordance with the present invention, the curing time has been reduced a number of hours if not several days from the oil techniques utilized in the past, even those that utilize ethylene as a curing agent. The time for the exposure of ethylene to the plant tissue has been found to be as low as 12–48 hours rather than the several days to a week that had been required previously. Thereafter the wilting and drying stages only a maximum of about 3½ days more.

The following is a specific example of the preferred embodiment:

A barn is filled with green tobacco leaves. The ethylene is metered out to a concentration within the barn of 50 ppm for the coloring stage to begin and the air flow from standard air movers is set at 96 exchanges per 24 hours. The humidity is maintained at approximately 87% R.H. for a time of 22 hours. The temperature is maintained at 85° F.–90° F.

During the wilting stage, the temperature is increased by 2½° F./hour to 118° F. and maintained for 8 hours. The air exchange is at the rate of 45 exchanges per 24 hours and the relative humidity is kept at about 65% R.H.

At the drying stage the temperature increased 2½° F./hour to a maximum of 160° F. with the relative humidity dropping to about 25% R.H. The air exchange is 8 exchanges per 24 hours. The tobacco should be dried in no more than 72 hours to the desired moisture content.

From the foregoing detailed description, it will be evident that there are a number of changes, adaptations and modifications of the present invention which come within the art to which the aforementioned invention pertains. However, it is intended that all such variations not departing from the spirit of the invention can be considered as within the scope thereof as limited solely by the appended claims.

I claim:

1. A process for coloring tobacco, comprising the steps of:

placing the tobacco within an enclosure containing air;

exposing the tobacco to ethylene gas in the concentration range of approximately 25–75 parts per million; and continuously exchanging the air within said enclosure approximately 10–110 times per 24-hour period for a time sufficient to produce the desirable color.

2. A process according to claim 1, wherein the tobacco is exposed to ethylene gas in the concentration range of 45–65 parts per million.

3. A process according to claim 1, wherein the air is exchanged 85–110 times per 24-hour period.

4. A process according to claim 3, wherein the air within the enclosure is maintained at approximately 85–95% relative humidity.

5. A process according to claim 3, wherein
the tobacco is exposed to ethylene gas in the concentration range of 45–65 parts per million, and
the air within the enclosure is maintained at approximately 85–95% relative humidity.

6. A process according to claim 3, wherein
the tobacco is exposed to ethylene gas in the concentration range of 45–65 parts per million, and
the air within the enclosure is maintained at approximately 85–95% relative humidity.

7. A process according to claim 3, wherein the tobacco is exposed to the ethylene gas for approximately 12–48 hours.

8. A process according to claim 3, wherein the tobacco is exposed to the ethylene gas preferably for 18–30 hours.

9. A process according to claim 3, wherein
the tobacco is exposed to ethylene gas in the concentration range of 45–65 parts per million, and
the tobacco is exposed to the ethylene gas for approximately 12–48 hours.

10. A process according to claim 3, wherein
the air is exchanged 85–110 times per 24-hour period, and
the tobacco is exposed to the ethylene gas for approximately 12–48 hours.

11. A process according to claim 3, wherein
the air within the enclosure is maintained at approximately 85–95% relative humidity, and
the tobacco is exposed to the ethylene gas for approximately 12–48 hours.

12. A process according to claim 3, wherein the temperature with the enclosure is maintained at approximately 70°–100° F.

13. A process according to claim 3, wherein
the tobacco is exposed to ethylene gas in the concentration range of 45–65 parts per million, and
the temperature with the enclosure is maintained at approximately 70°–100° F.

14. A process according to claim 13, wherein
the air is exchanged 85–110 times per 24-hour period, and
the temperature with the enclosure is maintained at approximately 70°–100° F.

15. A process according to claim 3, wherein
the air within the enclosure is maintained at approximately 85–95% relative humidity, and
the temperature with the enclosure is maintained at approximately 70°–100° F.

16. A process according to claim 3, wherein
the tobacco is exposed to the ethylene gas for approximately 12–48 hours, and
the temperature with the enclosure is maintained at approximately 70°–100° F.

17. A process according to claim 3, wherein
the air within the enclosure is maintained at approximately 85–95% relative humidity,
the tobacco is exposed to the ethylene gas for approximately 12–48 hours, and
the temperature with the enclosure is maintained at approximately 70°–100° F.

18. A process according to claim 1, wherein
the plant tissue is exposed to ethylene gas in the concentration range of 45–65 parts per million, and
the air is exchanged 85–110 times per 24-hour period.

19. A method shortening the time required to cure tobacco comprising,
coloring the tobacco in accordance with claim 1,
subsequent to coloring the tobacco, wilting the tobacco by increasing the temperature within said enclosure by up to at least 2° F. per hour until a temperature of about 118° F. is attained and continuing exposure of said tobacco to said temperature until said tobacco is wilted, and thereafter drying said tobacco.

20. The method of claim 19 wherein,
said increasing the temperature during wilting is within the range of 2° F.–3° F./hour.

21. The method of claim 20 wherein,
said temperature increase during wilting is 2° F.–2½° F./hour.

22. The method of claim 19 wherein,
the time of said coloring is about approximately 18–30 hours and the air is exchanged 85–110 times per 24-hour period.

23. The method of claim 22 wherein,
said increasing the temperature during wilting is within the range of 2° F.–3° F./hour,
the wilting occurs within 4–15 hours, and
the air exchange during the wilting stage is substantially within about the range of 40–50 exchanges per 24 hours.

24. The method of claim 22 wherein,
said increasing the temperature during wilting is within the range of 2° F.–3° F./hour,
the wilting occurs within 4–15 hours,
the air exchange during the wilting stage is substantially within about the range of 40–50 exchanges per 24 hours, and
during the drying period, the temperature within the enclosure is increased by 2° F.–3° F. per hour until a maximum temperature of about approximately 160° F. is attained.

25. The method of claim 22 wherein,
said temperature increase during wilting is 2° F.–2½° F./hour,
the wilting occurs within 6–12 hours,
the air exchange during the wilting stage is substantially within about the range of 40–50 exchanges per 24 hours, and
during the drying period, the temperature within the enclosure is increased by 2° F.–3° F. per hour until a maximum temperature of about approximately 160° F. is attained.

26. The method of claim 22 wherein,
said temperature increase during wilting is 2° F.–2½° F./hour,
the wilting occurs within 6–12 hours,
the relative humidity during the wilting stage is substantially within about the range of 60%–70% R.H.,
the air exchange during the wilting stage is substantially within about the range of 40–50 exchanges per 24 hours,
said temperature is increased during drying 2° F.–½° F. per hour until the maximum temperature of about 160° F. is attained, and
the period of increasing the temperature during the drying period is about approximately 50–60 hours followed thereafter with continued drying to cure the tobacco.

27. The method of claim 22 wherein, said temperature increased during wilting is 2° F.–2½° F./hour, the wilting occurs within 6–12 hours, the relative humidity during the wilting stage is substantially within about the range of 60%–70% R.H., the air exchange during the wilting stage is substantially within about the range of 40–50 exchanges per 24 hours, said temperature is increased during drying 2° F.–2½° F. per hour until the maximum temperature of about 160° F. is attained, the period of increasing the temperature during the drying period is about approximately 50–60 hours followed thereafter with continued drying to cure the tobacco, and the relative humidity during the drying stage is substantially within about the range of 20%–30% R.H. at the temperature of about 140° F.–160° F. and with about 6–10 air exchanges per 24 hours.

28. The method of claim 19 wherein, the wilting occurs within 4–15 hours.

29. The method of claim 28 wherein, the wilting occurs within 6–12 hours.

30. The method of claim 19 wherein, the drying is at least 50 hours.

31. The method of claim 19 wherein, during the drying period, the temperature within the enclosure is increased by 2° F.–3° F. per hour until a maximum temperature of about approximately 160° F. is attained.

32. The method of claim 31 wherein, said temperature is increased during drying 2° F.–2½° F. per hour until the maximum temperature of about 160° F. is attained.

33. The method of claim 31 wherein, the period of drying is at least 50 hours.

34. The method of claim 33 wherein, said temperature is increased during drying 2° F.–2½° F. per hour until the maximum temperature of about 160° F. is attained and the period of increasing the temperature during the drying period is about approximately 50–60 hours followed thereafter with continued drying to cure the tobacco.

35. The method of claim 19 wherein, said increasing the temperature during wilting is within the range of 2° F.–3° F./hour, the wilting occurs within 4–15 hours, and the drying is at least 50 hours.

36. The method of claim 19 wherein, said temperature increase during wilting is 2° F.–2½° F./hour, and the wilting occurs within 6–12 hours.

37. The method of claim 19 wherein, said increasing the temperature during wilting is within the range of 2° F.–3° F./hour, the wilting occurs within 4–15 hours, during the drying period, the temperature within the enclosure is increased by 2° F.–3° F. per hour until a maximum temperature of about approximately 160° F. is attained, and the period of increasing the temperature during the drying period is about approximately 50–60 hours followed thereafter with continued drying to cure the tobacco.

38. The method of claim 19 wherein, said increasing the temperature during wilting is within the range of 2° F.–3° F./hour, the wilting occurs within 4–15 hours, and during the drying period, the temperature within the enclosure is increased by 2° F.–3° F. per hour until a maximum temperature of about approximately 160° F. is attained.

39. The method of claim 19 wherein, during the drying period, the temperature within the enclosure is increased by 2° F.–2½° F. per hour until a maximum temperature of about approximately 160° F. is attained, and the period of increasing the temperature during the drying period is about approximately 50–60 hours followed thereafter with continued drying to cure the tobacco.

40. The method of claim 19 wherein, said temperature increase during wilting is 2° F.–2½° F./hour, the wilting occurs within 6–12 hours, and during the drying period, the temperature within the enclosure is increased by 2° F.–2½° F. per hour until a maximum temperature of about approximately 160° F. is attained.

41. The method of claim 19 wherein, the time of said coloring is about approximately 18–30 hours and the air is exchanged 85–110 times per 24-hour period, said temperature increase during wilting is 2° F.–2½° F./hour, the wilting occurs within 6–12 hours, during the drying period, the temperature within the enclosure is increased by 2° F.–2½° F. per hour until a maximum temperature of about approximately 160° F. is attained, the period of increasing the temperature during the drying period is about approximately 50–60 hours followed thereafter with continued drying to cure the tobacco.

42. The method of claim 19 wherein, the relative humidity during the wilting stage is substantially within about the range of 60%–70% R.H.

43. The method of claim 19 wherein, the air exchange during the wilting stage is substantially within about the range of 40–50 exchanges per 24 hours.

44. The method of claim 19 wherein, the relative humidity during the drying stage is substantially within about the range of 20%–30% R.H. at the temperature of about 140° F.–160° F. and with about 6–10 air exchanges per 24 hours.

* * * * *

REEXAMINATION CERTIFICATE (1478th)

United States Patent [19] [11] B1 4,836,222

Livingston [45] Certificate Issued May 28, 1991

[54] PROCESS FOR TREATING TOBACCO

[76] Inventor: Larry J. Livingston, 4768 Hermitage Rd., Virginia Beach, Va. 23455

Reexamination Request:
No. 90/001,968, Mar. 21, 1990

Reexamination Certificate for:

| | |
|---|---|
| Patent No.: | **4,836,222** |
| Issued: | **Jun. 6, 1989** |
| Appl. No.: | **215,522** |
| Filed: | **Jul. 6, 1988** |

[51] Int. Cl.[5] ..... A24B 15/30
[52] U.S. Cl. ..... 131/310; 131/300; 131/302
[58] Field of Search ..... 131/310, 309, 290, 302, 131/300

[56] References Cited

PUBLICATIONS

Walker et al: *Physical and Chemical Characteristics of Flue-cured Tobacco Cured with and without Ethylene Gas*, Tobacco Science (1985/Jan.).

Label for Ethy-Gen Concentrate of Catalytic Generators, Inc., Norfolk, Va., accepted under EPA Registration No. 37433-1, 12/14/78.

Brochure entitled "Ethylene for Use as Herbicide and Plant Growth Regulator," produced by Air Products and Chemicals, Inc., Allentown, Pa. and accepted under EPA Registration No. 28472-9, 4/30/79.

Goren, Raphael and Sisler, Edward, *Ethylene Binding: Some Parameters in Tobacco Leaves*, Tobacco Science, vol. 28, pp. 110-115 (1984).

Brochure entitled "Bulk Curing with Bulktobac," produced by G.F.P., Bulktobac Division, Charlotte, N.C. dated Nov., 1976.

Rakatin, Y. V., et al., *Acceleration of the Process of Curing of Tobacco Leaves with the Aid of Ethylene*, Soviet Plant Physiol., vol. 23, pp. 905-909 (1977).

Sisler, Edward and Yang, Shang Fa, *Ethylene, the Gaseous Plant Hormone*, BioScience, vol. 34, pp. 234-238 (1984).

Roberts, J. A. and Tucker, G. A., *Ethylene and Plant Development*, pp. 322-323 (1985).

Instructions for Airco Regulator No. 805 9499, Model 1000, dated 6/17/83.

Sisler, Edward, *Role of Carbon Dioxide in Reversing Ethylene Action in Tobacco Leaves*, Tobacco Science, XXIV: pp. 53-55 (1980).

Knight, James, *Tobacco Coloring Generators: What Can Ethylene Gas Do to Help Cure Your Tobacco?*The Flue Cured Tobacco Farmer, vol. 17, Number 6, pp. 22-23 (Jun. 1980).

Label for Livingston's Tobacco Curing Gas, of Livingston Chemicals, Inc., Virginia, copyrighted 1984 and accepted under EPA Registration No. 47893-2, Sep. 20, 1984.

*Primary Examiner*—V. Millin

[57] ABSTRACT

A process for degreening and coloring tobacco by subjecting the tobacco to air containing ethylene gas and thereafter wilting, dehydrating and curing. The air containing ethylene gas is exchanged within a controlled environment at a substantially high rate to not only replenish the oxygen and nitrogen content, but also to remove the carbon dioxide generated in the coloring process that can inhibit further coloring. The process also permits increasing the temperature around the tobacco during the wilting and dehydrating stages so as to substantially decrease the total time required for curing the tobacco.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETEMRINED THAT:

Claim 1 is determined to be patentable as amended.

Claims 2–44, dependent on an amended claim, are determined to be patentable.

New claim 45 is added and determined to be patentable.

1. A process for coloring tobacco, comprising the steps of:

(a) placing the tobacco within an enclosure containing air;

(b) [exposing the tobacco to ethylene gas in the concentration range of approximately 25–75 parts per million;] *emitting substantially pure ethylene from a cylinder and exposing the tobacco to the substantially pure ethylene in the concentration range of approximately 25–75 ppm;* and (c) continuously exchanging the air within said enclosure approximately 10–110 times per 24-hour period for a time sufficient to produce the desirable color.

*45. The process for coloring tobacco of claim 1 including the step of maintaining the concentration of $CO_2$ within the enclosure within the range of 0.25–0.5 ppm.*

* * * * *